United States Patent [19]

Katoh

[11] Patent Number: 4,713,511

[45] Date of Patent: Dec. 15, 1987

[54] CONTINUOUS SUBSTANTIALLY PLANAR MICROWAVE OVEN DOOR ASSEMBLY

[75] Inventor: Hiroyuki Katoh, Osaka, Japan

[73] Assignee: Sharp Kabushiki Kaisha, Osaka, Japan

[21] Appl. No.: 29,398

[22] Filed: Mar. 23, 1987

Related U.S. Application Data

[63] Continuation of Ser. No. 784,589, Oct. 4, 1985, abandoned.

[30] Foreign Application Priority Data

Oct. 15, 1984 [JP] Japan ..... 59-155646[U]

[51] Int. Cl.[4] ..... H05B 6/76

[52] U.S. Cl. ..... 219/10.55 D; 174/35 MS

[58] Field of Search ..... 219/10.55 D, 10.55 R; 174/35 MS, 35 R

[56] References Cited

U.S. PATENT DOCUMENTS

| | | | |
|---|---|---|---|
| 2,958,754 | 11/1960 | Hahn | 219/10.55 D |
| 3,843,859 | 10/1974 | Klemp | 219/10.55 D |
| 3,956,608 | 5/1976 | Imberg et al. | 219/10.55 D |
| 3,985,993 | 10/1976 | Imberg et al. | 219/10.55 D |
| 4,008,383 | 2/1977 | Tanaka et al. | 219/10.55 D |
| 4,159,406 | 6/1979 | Tate et al. | 219/10.55 D |
| 4,254,318 | 3/1981 | Ohkawa et al. | 219/10.55 D |
| 4,523,069 | 6/1985 | Staats | 219/10.55 D |

FOREIGN PATENT DOCUMENTS

| | | |
|---|---|---|
| 2853616 | 12/1977 | Fed. Rep. of Germany . |
| 3106786 | 2/1981 | Fed. Rep. of Germany . |
| 51-137152 | 6/1976 | Japan . |

*Primary Examiner*—Philip H. Leung

*Attorney, Agent, or Firm*—Birch, Stewart, Kolasch & Birch

[57] ABSTRACT

A microwave oven door includes a flange forming a choke cavity to prevent microwaves from leaking, the flange having first and second walls forming a door surface opposite to a heating chamber such that the first and the second walls accommodate an opening therebetween, a sealer plate secured on the second wall of the flange to view the interior of the microwave oven, the sealer plate and the first wall of the flange being disposed on a same plane, a door film disposed on a plane formed by the sealer plate and the first wall of the flange, and an opaque film formed on a portion of the door film corresponding to the opening of the flange.

6 Claims, 5 Drawing Figures

CONTINUOUS SUBSTANTIALLY PLANAR MICROWAVE OVEN DOOR ASSEMBLY

This application is a continuation of application Ser. No. 784,589 filed on Oct. 4, 1985, now abandoned.

BACKGROUND OF THE INVENTION

The present invention relates to a microwave oven door and, more particularly, to a microwave oven door including a choke cavity for absorbing microwaves.

FIG. 1 shows a sectional view of a microwave oven including a door in a related art of the present invention. A heating chamber 3 is provided in an external casing 1 of a microwave oven, while a magentron 2 generating high frequency microwaves is provided on the upper part of the heating chamber 3. A foodstuff 5 to be heated by the microwaves is disposed in a food plate 4 on the inside bottom wall of the heating chamber 3.

FIG. 2 shows an enlarged sectional view of the microwave oven door assembly of FIG. 1. A door body 7 comprises a flange 7' forming a choke cavity 6 to absorb microwaves. The flange 7' surrounds a central opening at the central portion of the door body 7. The central opening of the door body 7 is sealed by a sealer plate 11 such as a thin hole punched metal plate, and a transparent plate 9 such as a glass plate for supporting the sealer plate 11 to form an inner door screen. An inner door plate 10 is connected to the door body 7 by a screw 12 through a component attach plate 8 connected to the door body 7. The sealer plate 11 and the transparent plate 9 are sandwiched by the component attach plate 8 and the inner door plate 10 to fix the sealer plate 11 and the transparent plate 9 to the door body 7. A choke cover 13 is detachably provided to cover an opening **6*a* of a choke cavity 6 which is formed by the door body 7 and the inner door plate 10. A front screen 14 is sandwiched by the door body 7 and a screen hold plate 16 both connected to the door body 7 by a screw 15 to secure the front screen 14 on the door body 7. A decoration board 17 is provided at the external peripery of the door body 7 to conceal the screen hold plate 16 and the screw 15** securing it.

In the door assembly as shown in FIG. 2, a number of components are required for the assembly, such as choke cover 13, component attach plate 8, decoration plate 17, and screws 12 and 15, thus requiring much labor during assembly, and making it difficult to reduce costs. Also, the outer surface of the microwave oven opposite to the heating chamber is not flat because the components form a noticeable concave or convex appearance, so that it is difficult to clean the inner side of the microwave oven door. It is desired that a novel microwave oven door be provided to be substantially flat and easily cleaned.

SUMMARY OF THE INVENTION

Accordingly, it is an object of the present invention to provide a microwave oven door which can be assembled at low cost by minimizing door component elements in order that the assembly process can be significantly simplified.

It is another object of the present invention to provide a microwave oven door which is substantially flat and is easily cleaned.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, a microwave oven door comprises flange means forming a choke cavity to prevent microwaves from leaking. The flange means having first and second walls forming a door surface opposite to a heating chamber such that the first and the second walls accommodate an opening therebetween, and sealer plate means secured on the second wall of the flange means to view the interior of the microwave oven. The sealer plate means and the first wall of the flange means are disposed on a same plane. Preferably, door film means may be disposed on a plane formed by the sealer plate means and the first wall of the flange means and opaque film means may be formed on a portion of the door film means corresponding to the opening of the flange means.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 3:
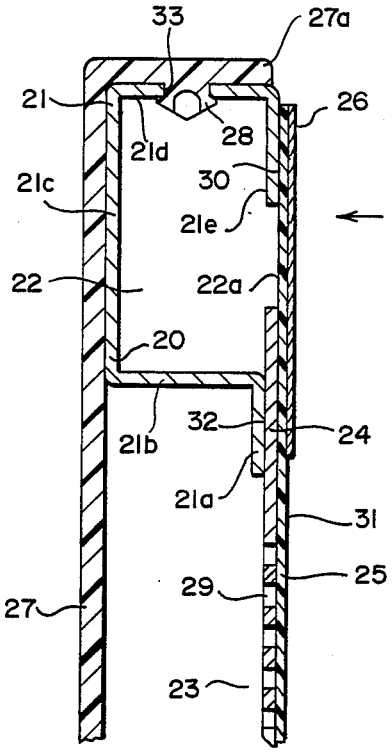
FIG. 3 shows an enlarged sectional view of the microwave oven door according to an embodiment of the present invention.
Figure 4:
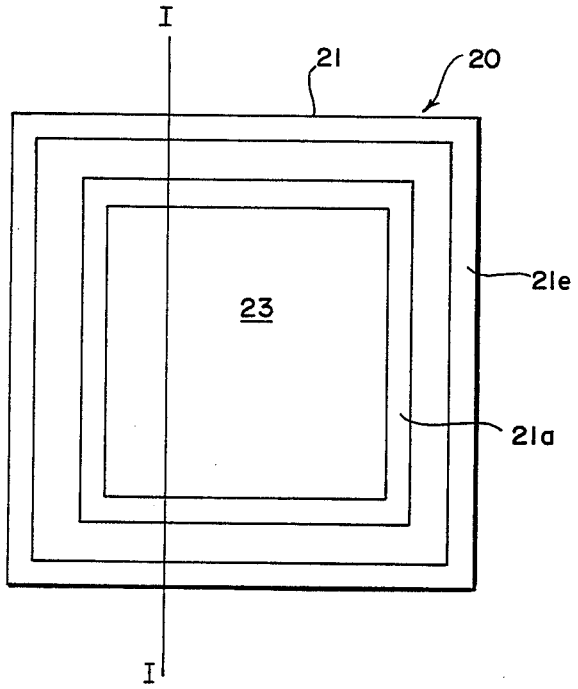
FIG. 4 shows a plan view in the arrow direction of a door body of the microwave oven door of FIG. 3.
Figure 5:
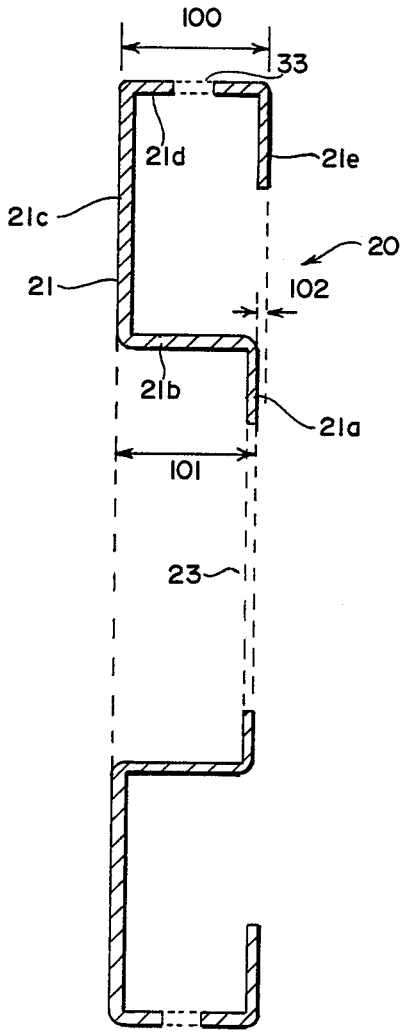
FIG. 5 shows a sectional view of the door body of the microwave oven door of FIG. 4 taken along the line I—I.

A preferred embodiment of a microwave oven door of the present invention will be described with reference to FIGS. 3, 4, and 5. FIG. 3 shows an enlarged sectional view of a microwave oven door according to an embodiment of the present invention. FIG. 4 shows a plan view in the arrow direction of a door body of the microwave oven door of FIG. 3. FIG. 5 shows a sectional view of the door body of the microwave oven door of FIG. 4 taken along the line I—I.

A door body 20 comprises a flange 21 forming a choke cavity 22 for absorbing microwaves. The flange 21 surrounds a central opening 23 at the central portion of the door body 20. The flange 21 comprises a first wall **21*a* bent and extended in the direction of the central opening 23 of the door body 20, a second wall 21*b* perpendicular to the first wall 21*a*, a third wall 21*c* perpendicular to the second wall 21*b* and parallel to the first wall 21*a*, a fourth wall 21*d* perpendicular to the third wall 21*c* and parallel to the second wall 21*b*, and a fifth wall 21*e* bent and extended in the direction of the central opening 23 and perpendicular to the fourth wall 21*d* and parallel to the first wall 21*a*. The first, the second, the third, the fourth, and the fifth walls 21*a*, 21*b***, 21c, 21d, and 21e form the choke cavity 22. The choke cavity 22 has an opening 22a opposite to a heating chamber 3. The flange 21 is formed in an "U" shape. The opening of the "U" shaped flange 21 is faced to the heating chamber 3.

A sealer plate 24 is connected and secured to the first wall 21a of the flange 21 of the door body 20 so that the sealer plate 24 covers central opening 23 and the end of the sealer plate 24 extends in the direction of opening 22a of the choke cavity 22 over the first wall 21a of the flange 21. The sealer plate 24, preferably, is made of a punched metal plate and has a plurality punched holes 29 provided to view the interior of the microwave oven. The outer surface 30 of the fifth wall 21e of the flange 21 of the door body 20 and the outer surface 31 of the sealer plate 24 are set on a same plane so as to form a substantially flat surface of the oven door opposite to the heating chamber 3. A door film 25 is adhered by an adhesive on the fifth wall 21e of the flange 21 and the sealer plate 24 so that the door film 25 covers opening 22a of choke cavity 22. An opaque film 26 is adhered on the door film 25 so that the opening 22a of the choke cavity 22 is sealed by the opaque film 26. The sealer plate 24 prevents microwaves from leaking to the outside. The door film 25 is provided to prevent vapor from entering through the punching holes 29 of the sealer plate 24.

Figure 1:
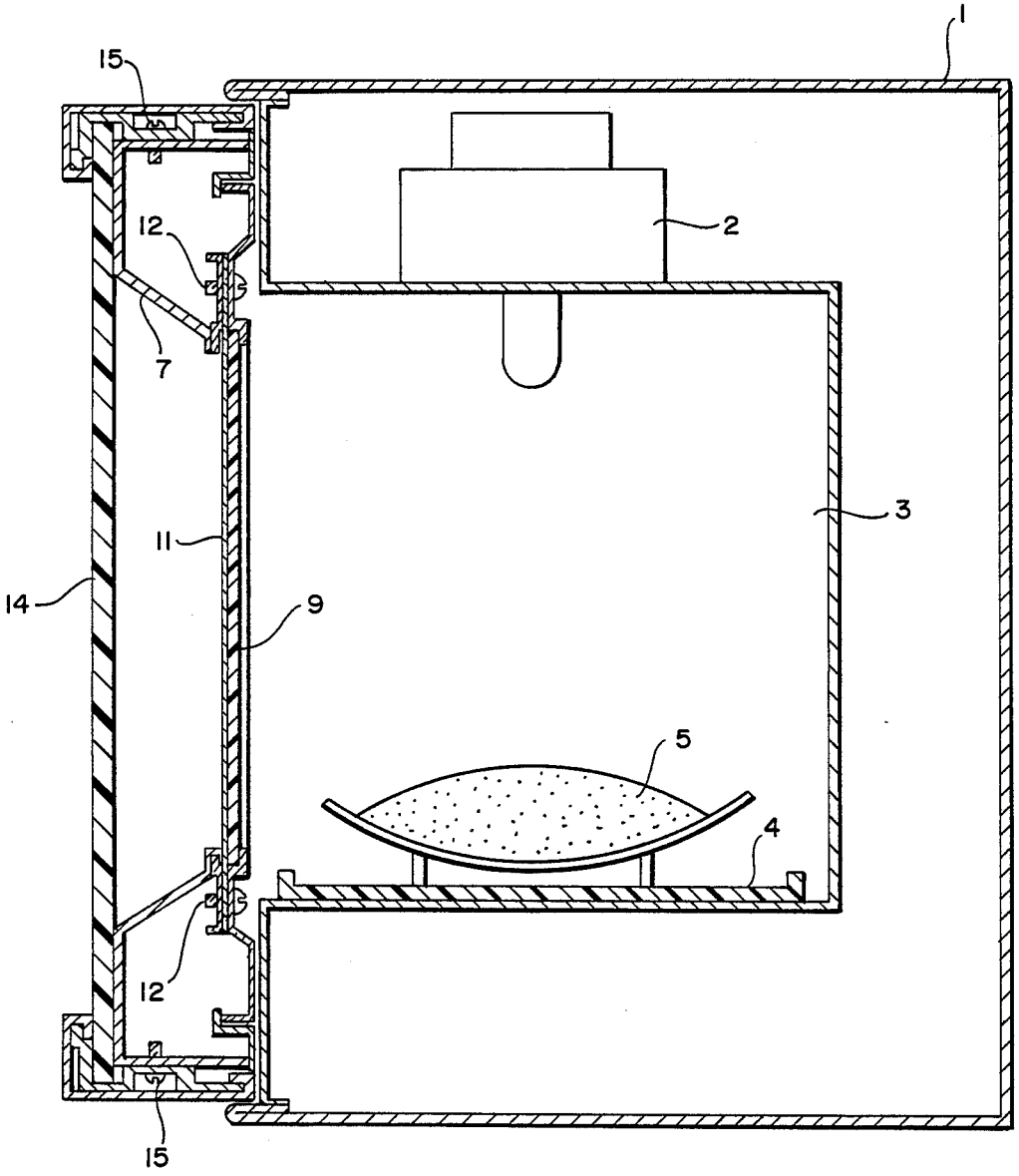
Fig. 1 PRIOR ART
FIG. 1 shows a sectional view of a microwave oven including a door in a related art of the present invention.
Figure 2:
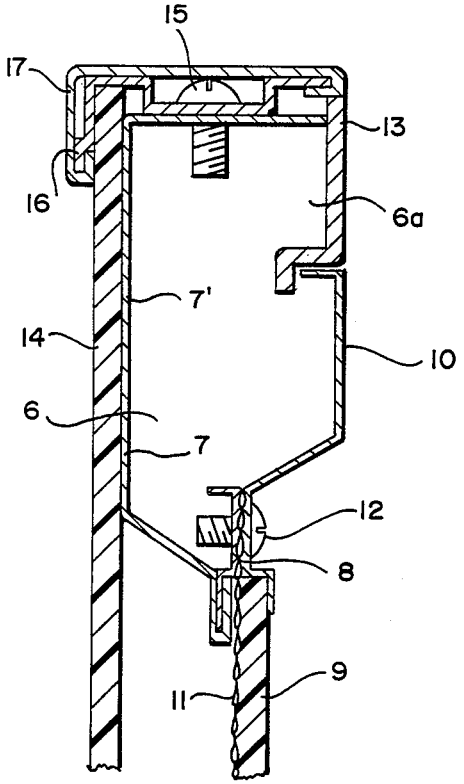
Fig. 2 PRIOR ART
FIG. 2 shows an enlarged sectional view of the microwave oven door of FIG. 1.

The opening side of the flange 21 is faced to the heating chamber 3. The construction of the microwave oven is shown in FIG. 1. The door assembly of the present invention differs from the door assembly as shown in FIG. 1.

In FIG. 5 length 100 of the fourth wall 21d of the flange 21 is greater than that of the length 101 of the second wall 21b of the flange 21 by the width 102 of the sealer plate 24. Accordingly, when the sealer plate 24 is welded and fixed on the first wall 21a of the flange 21. The surface of the fifth wall 21e is in the same plane as the surface of the sealer plate 24.

The sealer plate 24 is fixed on the first wall 21a of the flange 21 by a projection welding method. A plurality of small-sized projections are provided on the surface 32 of the first wall 21a of the flange 21 to enable projection welding sealer plate 24 on the first wall 21a. The width 102 of the sealer plate 24 of the present invention is larger than that of the sealer plate in the related art of the present invention. The surface of the sealer plater 24 opposite to the heating chamber 3 is in the same plane as the surface of the fifth wall 21e opposite to the heating chamber 3.

The door film 25, preferably, is made of a synthetic resin of a transparent type or a transparent glass, and adhered to the fifth wall 21e of the flange 21 and the sealer plate 24 by adhesive. The opaque film 26 may be formed as follows. (1) A black color paint is coated or printed on the door film 25. (2) An opaque film is adhered on the door film 25 by adhesive.

On the opposite side of the door facing away from the heating chamber, a front screen 27 is disposed at the front side of the door body 20. The front screen 27 is, preferably, made of a synthetic resin of a transparent type. The front screen 27 includes a flange 27a perpendicular to the front surface of the front screen 27. The flange 27a is formed at the periphery of the front surface of the front screen 27, and cover the third and the fourth walls 21c and 21d of the flange 21 of the door body 20. The flange 27a has a plurality of small-size projections 28 connecting or engaging the front screen 27 with the door body 20. The fourth wall 21d of the flange 21 of the door body 20 has a plurality of holes 33 positioned facing small-size projections 28 of the flange 27a of the front screen 27. When the small-size projections of the flange 27a of the front screen 27 are engaged with the holes 33 of the forth wall 21d of the flange 21 of the door body 20, the front screen 27 is fixed to the door body 20.

The assembly of the microwave oven door having the above construction will be described below. The sealer plate 24 is welded on the first wall 21a of the flange 21 of the door body 20 by projection welding. The door film 25 is adhered on the sealer plate 24 and the fifth wall 21e of the flange 21 of the door body 20 to cover the opening 22a of the choke cavity 22. If the opaque film 26 is formed on the door film 25 before the door film 25 is adhered, the coating or the printing of the opaque film 26 may be eliminated. The front screen 27 is engaged with the door body 20 by engaging the small-size projections 28 with the holes 33, respectively. The assembly is thereby completed.

Because the door film 25 is formed and covered on the whole surface of the door body 20 at the side adjacent heating chamber 3, the opening 22a of choke cavity 22 is covered and sealed by the door film 25. Because the sealer plate 24 and the fifth wall 21e of the flange 21 are in the same plane and the door film 25 is adhered on the sealer plate 24 and the fifth wall 21e of the flange 21 of the door body 20, the outer surface of the oven door at the side of the heating chamber 3 is easily cleaned.

Because the opaque film 26 is provided over the portion of the opening 22a of the choke cavity 22, the inside of the choke cavity 22 cannot be viewed from the outside even when the door is opened. Therefore, the choke cover required in the related art can be eliminated. The film 26 should not be limited to opaque film. The film 26 may be transparent. For example, a transparent film having close patterns may be used.

As described above, the outer wall of the flange portion 21e of the door body 20 disposed at the outside of the opening 22a of the choke cavity 22 of the door body 20 and the outer wall of the sealer plate 24 fixed to the door body 7 are in the same plane. The door film 25 is adhered on a plane formed by the outer wall of the flange portion 21e and the sealer plate 24 and covers opening 22a of choke cavity 22. The opaque film 26 is formed on the door film 25 corresponding to the portion of the opening 22a of the choke cavity 22.

Although a choke cover for covering a choke cavity in the present invention is used in the related art of the present invention, in the present invention the door film 25 to form the door screen can be used to cover a choke cavity thus simplifying construction. Therefore, the door is assembled at a low cost and the assembly can be significantly simplified.

Because the opaque film covering opening 22a of the choke cavity 22 is not transparent, the inside of the choke cavity 22 does not appear from the outside of the microwave oven when the door is opened. As the outer wall of the sealer plate 24 and the outer wall of the flange portion 21e of the door body 20, forming the surface of the door adjacent heating chamber 3, are substantially in the same plane, a noticeable concave or convex door surface can be eliminated. Therefore, the surface of the door adjacent to the heating chamber 3 is easily cleaned.

The door film 25 should not be limited to only transparent film. The door film 25 may be transparent at the central opening 23 of the door body 20, and opaque at the opening 22*a* of the choke cavity 22.

The gist of the present invention is that the sealer plate 24 is flush with flange wall portion 21*e*.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A substantially planar microwave oven door assembly, for sealing a heating chamber of a microwave oven, comprising:

a substantially planar door body comprising a flange forming a choke cavity, said flange surrounding a central opening in said door body, said flange having first, second and third wall portions, said second wall portion connecting said first and third wall portions with an opening into said choke cavity existing between said first wall portion and said second wall portion;

said first wall portion of said flange is located at an outer perimeter of said flange, said first wall portion being substantially planar and substantially parallel with one side of said second wall portion;

said third wall portion of said flange is located at an inner perimeter of said flange;

a substantially planar sealer plate operatively attached to said third wall portion with said sealer plate being located in the same plane as said first wall portion; and a door film laminated to and substantially covering entirely said first flange portion, said sealer plate and said opening into said choke cavity for providing a first side of the microwave oven door assembly with a continuous substantially planar surface.

2. The microwave oven door assembly according to claim 1, in which said sealer plate includes a plurality of holes for providing a see-through microwave oven door assembly.

3. The microwave oven door assembly according to claim 1, including a substantially planar front screen mounted to said door body for providing a substantially planar surface on a second side of the microwave oven door assembly, said front screen including a flange surrounding the outer perimeter of said door body, said flange having a plurality of projections for engaging with a plurality of holes located in the outer perimeter of said door body for securing said front screen to said door body.

4. The microwave door assembly according to claim 3, in which said second wall portion has substantially a C-shape with two sides substantially perpendicular to said sealer plate and said one side substantially parallel to said front screen.

5. The microwave door assembly according to claim 1, including an opaque sheet laminated to a portion of said door film that covers said opening into said choke cavity.

6. A substantially planar oven door assembly, for sealing a heating chamber of a microwave oven, comprising:

a substantially planar door body comprising a flange forming a cavity, said flange surrounding a central opening in said door body, said flange having first, second and third wall portions, said second wall portion connecting said first and third wall portions with an opening into said cavity existing between said first wall portion and said second wall portion;

said first wall portion of said flange is located at an outer perimeter of said flange, said first wall portion being substantially planar and substantially parallel with one side of said second wall portion;

said third wall portion of said flange is located at an inner perimeter of said flange;

a substantially planar sealer plate operatively attached to said third wall portion with said planar portion being located in the same plane as said first wall portion; and a door film laminated to and substantially covering entirely said first flange portion, said sealer plate and said opening into said cavity for providing a first side of the oven door assembly with a continuous substantially planar surface.

* * * * *